United States Patent [19]

Suzuki et al.

[11] Patent Number: 5,019,548

[45] Date of Patent: May 28, 1991

[54] HEAT SENSITIVE RECORDING MATERIAL

[75] Inventors: Toshitake Suzuki, Kobe; Fumio Seyama; Shuki Okauchi, both of Osaka; Toranosuke Saito, Ibaraki; Masakatu Kitani, Kobe; Takashi Ishibashi, Ibaraki, all of Japan

[73] Assignees: Kanzaki Paper Manufacturing Co., Ltd., Tokyo; Sanko Kaihatsu Kagaku Kenkyusho Corporation, Osaka, both of Japan

[21] Appl. No.: 397,821

[22] Filed: Aug. 24, 1989

[30] Foreign Application Priority Data

Sep. 7, 1988 [JP] Japan ..... 63-225129
Sep. 20, 1988 [JP] Japan ..... 63-238551

[51] Int. Cl.[5] ..... B41M 5/18

[52] U.S. Cl. ..... 503/209; 503/208; 503/216; 503/217; 503/225

[58] Field of Search ..... 427/150–152; 503/208, 209, 216, 217, 221, 225

[56] References Cited

PUBLICATIONS

JP-A-60-247592, Kanzaki Paper MFG, (CPI, G5: Printing Materials, Week 8604, p. 35).

JP-A-61-31287, Kanzaki Paper MFG, (CPI, G5: Printing Materials, Week 8613, p. 24).

JP-A-63-11087, Kanzaki Paper MFG (CPI, G5: Printing Materials, Week 8825, p. 37).

*Primary Examiner*—Bruce H. Hess

*Attorney, Agent, or Firm*—Armstrong, Nikaido, Marmelstein, Kubovcik & Murray

[57] ABSTRACT

A heat sensitive recording material comprising a substrate and a recording layer thereon incorporating a colorless or light-colored basic dye and a color acceptor reactive with the dye to form a color when contacted therewith, the recording material being characterized in that, as the color acceptor is used at least one compound selected from the group consisting of 4-hydroxy-4'-isopropyloxydiphenylsulfone, 4,4'-(1,3-dimethylbutylidene) bisphenol, 4,4'-(1-phenylethylidene)bisphenol, 4,4'-(p-phenylenediisopropylidene)bisphenol and 4,4'-(m-phenylenediisopropylidene) bisphenol, and to the recording layer is added at least one of a heat-fusible substance represented by the formula [I]

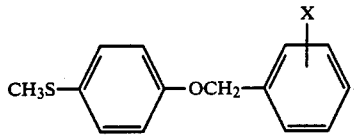

(I)

wherein X is hydrogen atom, halogen atom, $C_{1\sim4}$ alkyl or $C_{1\sim4}$ alkoxy.

7 Claims, No Drawings

HEAT SENSITIVE RECORDING MATERIAL

The present invention relates to a heat sensitive recording material, and more particularly to a heat sensitive recording material which has an excellent amenability to high-speed recording, and is free from decrease in whiteness of a background area (the recording layer) and excellent in retainability of the record image.

Heat sensitive recording materials are well known which are adapted to produce record images by thermally contacting a colorless or light-colored basic dye with an organic or inorganic color acceptor for a color forming reaction.

With remarkable progress in heat sensitive recording systems in recent years, heat sensitive facsimile systems, etc. are made operable at a high speed. For example, heat sensitive facsimile systems produce a copy of A4 size within 10 seconds. For use with such high-speed hardware, heat sensitive recording materials must meet the requirements of high-speed recording.

In order to enhance the recording sensitivity of the heat snesitive recording material, it is conventionally known to add to a recording layer a heat-fusible substance having a lower melting point than both of a basic dye and a color acceptor and to dissolve the dye and the color acceptor into the molten heat-fusible substance to lower a color formation commencing temperature (JP-A-49-34842, JP-A-53-39139, etc.). The term "JP-A" means an "unexamined published Japanese patent application". However, it is difficult that a single heat-fusible substance dissolves both of a basic dye and a color acceptor therein. Further, even when a molten mixture of a dye, color acceptor and heat-fusible substance is obtained, color formation commencing temperature lowers excessively due to a melting point depression by co-melting of the three compounds, which accompanies a defect that whiteness of a recording layer markedly decreases.

We have previously proposed phenyl benzyl ether derivative as a heat-fusible substance which is free from the above defect (JP-A-61-31287). Nevertheless, the heat sensitive recording material using the above phenyl benzyl ether derivative lowers in whiteness of the recording layer markedly after preserved at high temperature, and an improvement thereof is required.

In view of the above situation, we have widely investigated not only a heat-fusible substance but also a color acceptor used in combination therewith.

An object of the invention is to provide a heat sensitive recording material which has an excellent recording sensitivity and does not lower in whiteness when exposed at high temperature.

The above and other objects of the invention will become apparent from the following description.

We have found that the above object is achieved by using the following phenyl benzyl ether derivative of the formula [I] as a heat-fusible substance and the following specific compound as a color acceptor. The present invention is accomplished by the above finding.

The present invention provides a heat sensitive recording material comprising a substrate and a recording layer thereon incorporating a colorless or light-colored basic dye and a color acceptor reactive with the dye to form a color when contacted theirwith, the recording material being characterized in that, as the color acceptor is used at least one compound selected from the group consisting of 4-hydroxy-4'-isopropyloxydiphenylsulfone, 4,4'-(1,3-dimethylbutylidene)bisphenol, 4,4'-(1-phenylethylidene)bisphenol, 4,4'-(p-phenylenediisopropylidene)bisphenol and 4,4'-(m-phenylenediisopropylidene)bisphenol, and to the recording layer is added at least one of a heat-fusible substance represented by the formula [I]

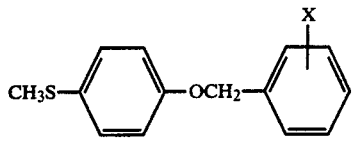

(I)

wherein X is hydrogen atom, halogen atom, $C_{1\sim4}$ alkyl or $C_{1\sim4}$ alkoxyl.

In the present invention, it is still remained to be clarified why a heat sensitive recording material which is excellent in high-speed recording property and is free from decrease in whiteness when preserved at high temperature is obtained by a conjoint use of the above specific compound as a color acceptor and the above compound of the formula [I] as a heat-fusible substance. It is presumed that the above color acceptor and the above heat-fusible substance exhibit high mutual solubility and nevertheless show a little melting point depression by co-melting.

Examples of the compound of the formula [I] are benzyl 4-methylthiophenyl ether, 4-chlorobenzyl 4'-methylthiophenyl ether, 3-chlorobenzyl 4'-methylthiophenyl ether, 4-bromobenzyl 4'-methylthiophenyl ether, 4-methylbenzyl 4'-methylthiophenyl ether, 2-methylbenzyl 4'-methylthiophenyl ether, 4-n-butylbenzyl 4'-methylthiophenylether and 4-methoxybenzyl 4'-methylthiophenyl ether. The compound is not limited to thereabove and can be used in a mixture of at least two of them.

In the present invention, as a color acceptor, is selectively used at least one compound selected from the group consisting of 4-hydroxy-4'-isopropyloxydiphenylsulfone, 4,4'-(1,3-dimethylbutylidene)bisphenol, 4,4'-(1-phenylethylidene)bisphenol, 4,4'-(p-phenylenediisopropylidene)bisphenol and 4,4'-(m-phenylenediisopropylidene)bisphenol.

The proportions of the color acceptor and the heat-fusible substance of the formula [I] are not particularly limited but usually 1 to 1000 parts by weight, preferably 10 to 300 parts by weight of the heat-fusible substance is used per 100 parts by weight of the color acceptor.

As a colorless or light-colored basic dye contained in the heat sensitive recording layer conjointly with specific color acceptor and heat-fusible substance in the present invention are used various known basic dyes. Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoylleucomethyleneblue, p-nitrobenzoyl-leucomethyleneblue, etc.

Spiro-based dyes, e.g., 3-methyl-spirodinaphthopyran, 3-ethyl-spiro-dinaphthopyran, 3-phenylspirodinaphthopyran, 3-benzyl-spiro-dinaphthopyran, 3-methyl-naphtho-(6'-methoxybenzo)spiropyran, 3-propyl-spirodibenzopyran, etc.

Lactam-based dyes, e.g., rhodamine-B-anilinolactam, rhodamine-(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorflouran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-(N-methyl-N-benzylamino)-fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-di(n-butyl)amino-6-methyl-7-phenylaminofluoran, 3-di(n-pentyl)amino-6-methyl-7-phenylaminofluoran, 3-diethylamino-7-(2-carbomethoxyphenylamino)fluoran, 3-(N-ethyl-N-isoamyl-)amino-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-di(n-butyl)amino-7-(o-chlorophenylamino)flouran, 3-(N-ethyl-N-tetrahydrofurfuryl)amino-6-methyl-7-phenylaminofluoran, 3-(N-methyl-N-n-propyl)amino-6-methyl-7-phenylaminofluoran, 3-pyrrolidino-6-methyl-7-p-butylphenylaminofluoran, 3-(N-ethyl-N-n-propyl)amino-6-methyl-7-phenylaminofluoran, 3-(N-ethyl-N-isobutyl)amino-6-methyl-7-phenylaminofluoran, 3-(N-methyl-N-n-hexyl-)amino-6-methyl-7-phenylaminofluoran, 3-(N-ethyl-N-n-hexyl)amino-6-methyl-7-phenylaminofluoran, 3-(N-ethyl-N-cyclopentyl)amino-6-methyl-7-phenylaminofluoran, etc. These basic dyes are not limited to thereabove and can be used, as required, in a mixture of at least two of them.

Among the above basic dyes preferable are 3-di(n-butyl)amino-6-methyl-7-phenylaminofluoran and 3-di(n-pentyl)amino-6-methyl-7-phenylaminofluoran, since a heat sensitive recording material can be obtained which is particularly high in recording sensitivity and in whiteness of the recording layer.

The proportions of the above specific color acceptor and the basic dye are not necessarily limited but usually 100 to 700 parts by weight, preferably 150 to 400 parts by weight, of the color acceptor is used per 100 parts by weight of the basic dye.

For preparing a coating composition comprising the foregoing components, the basic dye, the color acceptor and the heat-fusible substance of the formula [I] are dispersed, together or individually, into water serving as a dispersion medium, using stirring and pulverizing means such as a ball mill, attritor or sand mill. Usually the coating composition has incorporated therein a binder in an amount of 10 to 40% by weight, preferably 15 to 30% by weight, based on the total solids content of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc.

Various other auxiliary agents can be further added to the coating composition. Examples of useful agents are dispersants such as sodium dioctylsulfosuccinate, sodium dodecylbenzenesulfonate, sodium lauryl sulfate, fatty acid metal salts, etc., ultraviolet absorbers such as triazole compounds, defoaming agents, fluorescent dyes, coloring dyes, etc. Further, to the composition may be added, in order to prevent sticking upon contact of the heat sensitive recording material with a recording device or thermal head, a dispersion or emulsion of stearic acid, polyethylene, carnauba wax, paraffin wax, zinc stearate, calcium stearate, ester wax or the like.

Further, to the composition may be added in an amount which does not cause adverse effect, aliphatic fatty acid amide such as stearic acid amide, stearic acid methylenebisamide, oleic acid amide, palmitic acid amide, coconut fatty acid amide, etc; ethers such as 1,2-bis(phenoxy)ethane, 1,2-bis(4-methylphenoxy)ethane, 1,2-bis(3-methylphenoxy)ethane, 2-benzyloxynaphthalene, etc; esters such as dibenzyl terephthalate, 1-hydroxy-2-naphthoic acid phenyl ester, etc; and various known heat-fusible substances.

In addition, to the composition may be added in order to prevent the adhesion of tailings to the thermal head, inorganic pigment such as kaolin, clay, talc, calcium carbonate, calcined clay, titanium oxide, kieselguhr, finely divided anhydrous silica, activated clay, etc.

Further, in the present invention, it is possible to add to a coating composition for a recording layer a retainability improving agent in order to enhance whiteness of the recording layer and retainability of the record image. Examples of useful retainability improving agents are 2,2'-methylenebis(4-methyl-6-tert-butylphenol), 1,1,3-tris(2-methyl-4-hydroxy-5-tert-butylphenyl)butane, 1,1,3-tris(2-methyl-4-hydroxy-5-cyclohexylphenyl)butane, tetrakis[3-(3,5-di-tert-butyl-4-hydroxyphenyl)propionyloxymethyl]methane, 1,3,5-tris(3,5-di-tert-butyl-4-hydroxybenzyl)-2,4,6-trimethylbenzene and compounds of the formula [II]

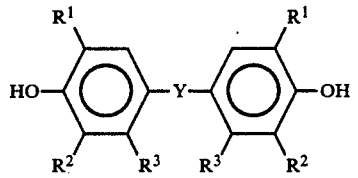

[II]

wherein $R^1$ is a branched-chain $C_{3\sim8}$ alkyl, cycloalkyl, phenyl or halogen atom, $R^2$ is hydrogen atom, straight-chain $C_{1\sim8}$ alkyl, branched-chain $C_{3\sim8}$ alkyl or halogen atom, $R^3$ is hydrogen atom or straight-chain $C_{1\sim4}$ alkyl, Y is —O—, —S—, —S—S—, —$SO_2$— or —$C(R^4)(R^5)$—, $R^4$ and $R^5$ are each hydrogen atom or straight-chain $C_{1\sim8}$ alkyl, and may form a ring together therewith.

Examples of useful compounds of the formula [II] are 4,4'-butylidenebis(2-tert-butyl-5-methylphenol), 4,4'-butylidenebis(2-tert-butyl-6-methylphenol), 4,4'-butylidenebis(2,6-di-tert-butylphenol), 4,4'-butylidenebis(2-cyclohexylphenol), 4,4'- butylidenebis(2-phenylphenol), 4,4'-cyclohexylidenebis(2-tert-butyl-5-methylphenol), 4,4'-cyclohexylidenebis(2-tert-butyl-6-methylphenol), 4,4'-cyclohexylidenebis(2,6-di-tert-butylphenol), 4,4'-cyclohexylidenebis(2-cyclohexylphenol), 4,4'-cyclohexylidenebis(2-phenylphenol), 4,4'-thiobis(2-tert-butyl-5-methylphenol), 4,4'-thiobis(2-tert-butyl-6-methylphenol), 4,4'-thiobis(2,6-di-tert-butylphenol), 4,4'-thiobis(2-cyclohexylphenol), 4,4'-thiobis(2-phenylphenol), 4,4'-isopropylidenebis(2,6-dichlorophenol), 4,4'-isopropylidenebis(2,6-dibromophenol), 4,4'-cyclohexylidenebis(2,6-dichlorophenol), 4,4'-cyclohexylidenebis(2,6-dibromophenol), bis(4-hydroxy-3,5-dichlorophenyl)sulfone, bis(4-hydroxy-3,5-dibromophenyl)sulfone, bis(4-hydroxy-3,5-dichlorophenyl)sulfide, bis(4-hydroxy-3,5-dibromophenyl)sulfide, bis(4-hydroxy-3,5-dichlorophenyl)ether, bis(4-hydroxy-3,5-dibromophenyl)ether, bis(4-hydroxy-3,5-dichlorophenyl)disulfide and bis(4-hydroxy-3,5-di-bromophenyl)disulfide.

Among these retainability improving agents, preferable are tetrakis[3-(3,5-di-tert-butyl-4-hydroxyphenyl)-propionyloxymethyl]methane, 1,3,5-tris(3,5-di-tert-butyl-4-hydroxybenzyl)-2,4,6-trimethylbenzene and the compound of the formula [II], particularly 4,4'-butylidenebis(2-tert-butyl-5-methylphenol). With these agents, a heat sensitive recording material can be obtained which is extremely low in decrease of whiteness and in discoloration in the record images even when exposed at high temperature.

The amount of the retainability improving agent is not necessarily limited but usually 1 to 100 parts by weight, preferably 4 to 25 parts by weight of the agent is used per 100 parts by weight of the compound of the formula [I]. The agent can be used singly or in a mixture of at least two of them.

The present heat sensitive recording material is characterized in that at least one of the above specific compound is used as a color acceptor. It is possible, however, to use conjointly, in an amount which does not cause adverse effect, other color acceptors such as 4,4'-isopropylidenediphenol, 4,4'-cyclohexylidenediphenol, benzyl 4-hydroxybenzoate, dimethyl 4-hydroxyphthalate, complex of zinc thiocyanate with antipyrine, etc.

As a substrate (support) to be coated, may be used a paper, plastic film, synthetic fiber sheet or the like, but a paper is most preferably used from a viewpoint of cost, coating applicability, etc. The amount of coating composition forming the recording layer to be applied to the support, which is not limited particularly, is usually about 2 to 12 g/m$^2$, preferably about 3 to 10 g/m$^2$, based on dry weight.

The heat sensitive recording materials thus obtained are high in recording sensitivity and whiteness, hardly decrease in whiteness when preserved at high temperature and are free from piling of residue on the thermal head, due to a selective use of specific color acceptor and heat-fusible substance.

Further, it is possible to form an over-coat layer on the recording layer to protect the layer. Various other known techniques in the field of heat sensitive recording material can be applied. For example, it is possible to form a protective layer on the rear surface of the support, to form a primary coating layer (an intermediate layer) on the support, to form an adhesive layer on the rear surface of the support.

The invention will be described below in more detail with reference to Examples by no means limited to, in which parts and percentages are all by weight, unless otherwise specified.

EXAMPLE 1

Formation of an intermediate layer

| | |
|---|---|
| Calcined clay (trade name: Ansilex apparent specific gravity: 0.22 g/cm$^3$, Engelhard Minerals & Chemicals Corp.) | 100 parts |
| Styrene-butadiene copolymer latex (solids: 50%) | 15 parts |
| 10% Aqueous solution of polyvinyl alcohol | 30 parts |
| Water | 200 parts |

These components were mixed to prepare a coating composition for an intermediate layer. To a paper substrate weighing 50 g/m$^2$ was applied and dried the above coating composition in an amount of 10 g/m$^2$ by dry weight to form an intermediate layer.

Preparation of a heat sensitive recording paper (1) Composition (A)

| | |
|---|---|
| 3-(N-Ethyl-N-isoamyl)amino-6-methyl-7-phenylaminofluoran | 10 parts |
| Benzyl 4-methylthiophenyl ether | 20 parts |
| 5% Aqueous solution of methyl cellulose | 15 parts |
| Water | 120 parts |

These components were pulverized by a sand mill to prepare Composition (A) having an average particle size of 3 μm.

(2) Composition (B)

| | |
|---|---|
| 4-Hydroxy-4'-isopropyloxydiphenylsulfone | 30 parts |
| 5% Aqueous solution of methyl cellulose | 30 parts |
| Water | 70 parts |

These components were pulverized by a sand mill to prepare Composition (B) having an average particle size of 3 μm.

(3) Formation of a recording layer

A coating composition for a heat sensitive recording layer was prepared by mixing with stirring 165 parts of Composition (A), 130 parts of Composition (B), 30 parts of finely divided anhydrous silica (oil absorption 180 ml/100 g), 150 parts of 20% aqueous solution of oxidized starch and 55 parts of water. To the above intermediate layer was applied and dried the above coating composition in an amount of 5.0 g/m$^2$ by dry weight to obtain a heat sensitive recording paper.

EXAMPLES 2 to 5

Four kinds of heat sensitive recording papers were prepared in the same manner as in Example 1 excecpt that, in the preparation of Composition (B), 4,4'-(1,3-dimethylbutylidene)bisphenol (Example 2), 4,4'-(1-phenylethylidene)bisphenol (Example 3), 4,4'-phenylenediisopropylidene)bisphenol (Example 4) or 4,4'-(m-phenylenediisopropylidene)bisphenol (Example 5) was used in place of 4-hydroxy-4'-isopropyloxydiphenylsulfone.

EXAMPLES 6 to 10

Five kinds of heat sensitive recording papers were prepared in the same manner as in Examples 1 to 5 except that, in the preparation of Composition (A), 4-chlorobenzyl 4'-methylthiophenyl ether was used in place of benzyl 4-methylthiophenyl ether.

EXAMPLES 11 to 13

Three kinds of heat sensitive recording papers were prepared in the same manner as in Example 1 except that, in the preparation of Composition (A), 4-methylbenzyl 4'-methylthiophenyl ether (Example 11), 3-chlorobenzyl 4'-methylthiophenyl ether (Example 12) or 4-methoxybenzyl 4'-methylthiophenyl ether (Example 13) was used in place of benzyl 4-methylthiophenyl ether.

EXAMPLE 14

Preparation of a heat sensitive recording paper (1) Composition (C)

| | |
|---|---|
| 3-Di(n-butyl)amino-6-methyl-7-phenylaminofluoran | 10 parts |
| Benzyl 4-methylthiophenyl ether | 20 parts |
| 5% Aqueous solution of methyl cellulose | 15 parts |
| Water | 120 parts |

These components were pulverized by a sand mill to prepare Composition (C) having an average particle size of 3 μm.

(2) Composition (B)

| | |
|---|---|
| 4-Hydroxy-4'-isopropyloxydiphenylsulfone | 30 parts |
| 5% Aqueous solution of methyl cellulose | 30 parts |
| Water | 70 parts |

These components were pulverized by a sand mill to prepare Composition (B) having an average particle size of 3 μm.

(3) Formation of a recording layer

A coating composition for a heat sensitive recording layer was prepared by mixing with stirring 165 parts of Composition (C), 130 parts of Composition (B), 30 parts of finely divided anhydrous silica (oil absorption 180 ml/100 g), 150 parts of 20% aqueous solution of oxidized starch and 55 parts of water. To the intermediate layer obtained in the same manner as in Example 1 was applied and dried the above coating composition in an amount of 5.0 g/m$^2$ by dry weight to obtain a heat sensitive recording paper.

EXAMPLE 15

A heat sensitive recording paper was prepared in the same manner as in Example 14 except that, in the preparation of Composition (C), 3-di(n-pentyl)amino-6-methyl-7-phenylaminofluoran was used in place of 3-di(n-butyl)amino-6-methyl-7-phenylaminofluoran.

EXAMPLES 16 to 19

Four kinds of heat sensitive recording papers were prepared in the same manner as in Example 14 except that, in the preparation of Composition (B), 4,4'-(1,3-dimethylbutylidene)bisphenol (Example 16), 4,4'-(1phenylethylidene)bisphenol (Example 17), 4,4'-(p-phenylenediisopropylidene)bisphenol (Example 18) or 4,4'-(m-phenylenediisopropylidene)bisphenol (Example 19) was used in place of 4-hydroxy-4'-isopropyloxydiphenylsulfone.

COMPARISON EXAMPLE 1

A heat sensitive recording paper was prepared in the same manner as in Example 1 except that, in the preparation of Composition (B), 4,4'-isopropylidenediphenol was used in place of 4-hydroxy-4'-isopropyloxydiphenylsulfone.

COMPARISON EXAMPLE 2

A heat sensitive recording paper was prepared in the same manner as in Example 1 except that, in the preparation of Composition (A), stearic acid amide was used in place of benzyl 4-methylthiophenyl ether, and in the preparation of Composition (B), 4,4'-isopropylidenediphenol was used in place of 4-hydroxy-4'-isopropyloxydiphenylsulfone.

The 21 kinds of heat sensitive recording papers thus obtained were used for recording on a thermal facsimile simulator (voltage: 16 V, pulse cycle: 5 m sec., a product of Kyocera Corp.) with pulse width of 0.30 m sec. and 0.45 m sec. The color density of the images recorded was measured by a Macbeth reflective densitometer (Model RD-100R, a product of Macbeth Corp.) with an amber filter. The results were given in Table 1.

Further, each of the heat sensitive recording papers was checked for whiteness of the recording layer with use of a Hunter multipurpose reflectometer before recording. After allowed to place at 60° C. for 24 hours, each of the heat sensitive recording papers was again checked for whiteness. Table 1 also shows the result.

TABLE 1

| | Color density | | Whiteness (%) | |
|---|---|---|---|---|
| | 0.30 m sec. | 0.45 m sec. | Before heat treatment | After heat treatment |
| Ex. 1 | 0.80 | 1.35 | 84.5 | 80.1 |
| Ex. 2 | 0.72 | 1.28 | 85.6 | 84.0 |
| Ex. 3 | 0.77 | 1.33 | 84.0 | 82.8 |
| Ex. 4 | 0.75 | 1.31 | 84.7 | 83.2 |
| Ex. 5 | 0.75 | 1.30 | 84.0 | 82.4 |
| Ex. 6 | 0.70 | 1.27 | 83.8 | 81.9 |
| Ex. 7 | 0.68 | 1.20 | 85.5 | 84.0 |
| Ex. 8 | 0.70 | 1.26 | 84.2 | 83.1 |
| Ex. 9 | 0.69 | 1.26 | 85.2 | 84.1 |
| Ex. 10 | 0.69 | 1.27 | 84.7 | 83.5 |
| Ex. 11 | 0.74 | 1.31 | 83.6 | 81.7 |
| Ex. 12 | 0.78 | 1.34 | 83.6 | 81.8 |
| Ex. 13 | 0.72 | 1.28 | 83.8 | 82.0 |
| Ex. 14 | 0.79 | 1.36 | 85.3 | 84.0 |
| Ex. 15 | 0.80 | 1.37 | 85.2 | 83.9 |
| Ex. 16 | 0.70 | 1.26 | 87.2 | 85.7 |
| Ex. 17 | 0.75 | 1.34 | 86.0 | 84.7 |
| Ex. 18 | 0.74 | 1.31 | 86.7 | 85.1 |
| Ex. 19 | 0.73 | 1.31 | 87.1 | 84.5 |
| Com. Ex. 1 | 0.77 | 1.33 | 80.6 | 70.7 |
| Com. Ex. 2 | 0.30 | 0.75 | 83.6 | 78.7 |

EXAMPLE 20

A heat sensitive recording paper was prepared in the same manner as in Example 14 except that, in the formation of the recording layer, 168 parts of the following Composition (D) was used in place of 165 parts of Composition (C).

Composition (D)

| | |
|---|---|
| 3-Di(n-butyl)amino-6-methyl-7-phenylaminofluoran | 10 parts |
| Benzyl 4-methylthiophenyl ether | 20 parts |
| 4,4'-Butylidenebis(2-tert-butyl-5-methylphenol) | 3 parts |

-continued

| | |
|---|---|
| 5% Aqueous solution of methyl cellulose | 15 parts |
| Water | 120 parts |

These components were pulverized by a sand mill to prepare Composition (D) having an average particle size of 3 μm.

EXAMPLES 21 to 22

Two kinds of heat sensitive recording papers were prepared in the same manner as in Example 20 except that, in the preparation of Composition (D), tetrakis [3-(3,5-di-tert-butyl-4-hydroxyphenyl)propionyloxymethyl]methane (Example 21) or 1,3,5-tris(3,5-di-tert-butyl-4-hydroxybenzyl)-2,4,6-trimethylbenzene (Example 22) was used in place of 4,4'-butylidenebis(2-tert-butyl-5-methylphenol).

EXAMPLE 23

A heat sensitive recording paper was prepared in the same manner as in Example 20 except that, in the preparation of Composition (D), 3-(N-ethyl-N-isoamyl-)amino-6-methyl-7-phenylaminofluoran was used in place of 3-di(n-butyl)amino-6-methyl-7-phenylaminofluoran.

The 4 kinds of heat sensitive recording papers thus obtained were used for recording on a thermal facsimile simulator with pulse width of 0.30 m sec. and 0.45 m sec. The color density of the images recorded was measured by a Macbeth reflective densitometer. The results were given in Table 2.

Further, each of the heat sensitive recording papers was checked for whiteness of the recording layer with use of a Hunter multipurpose reflectometer before recording. After allowed to place at 60° C. for 24 hours, each of the heat sensitive recording papers was again checked for whiteness. Table 2 also shows the result.

In addition, the image recorded with pulse width of 0.45 m sec. was allowed to place at 60° C. for 12 hours and thereafter the degree of discoloration was observed with the unaided eye. The result was given in Table 2, in which the heat sensitive recording paper of Example 14 was also evaluated for comparison.

CRITERIA

◎: Almost no discoloration

○: Slight discoloration but the paper is usable free of problem

Δ: Considerable discoloration, making the paper slightly problem

TABLE 2

| | Color density | | Whiteness (%) | | Discoloration |
|---|---|---|---|---|---|
| | 0.30 m sec. | 0.45 m sec. | Before heat treatment | After heat treatment | After heat treatment |
| Ex. 20 | 0.81 | 1.36 | 85.5 | 84.1 | ○ |
| Ex. 21 | 0.82 | 1.36 | 85.2 | 83.7 | ○ |
| Ex. 22 | 0.81 | 1.35 | 85.3 | 83.9 | ○ |
| Ex. 23 | 0.80 | 1.36 | 84.5 | 80.3 | ◎ |
| Ex. 24 | 0.79 | 1.36 | 85.3 | 84.0 | Δ |

As apparent from Tables 1 and 2, the heat sensitive recording materials obtained in the present invention are high in the recording sensitivity and whiteness, and do not lower in whiteness even when exposed at high temperature.

We claim:

1. A heat sensitive recording material comprising a substrate and a recording layer thereof incorporating a colorless or light-colored basic dye and a color acceptor reactive with the dye to form a color when contacted therewith, wherein said color acceptor is at least one compound selected from the group consisting of 4-hydroxy-4'-isopropyloxydiphenylsulfone, 4,4'-(1,3-dimethyl-butylidene)bisphenol, 4,4'-(1-phenylethylidene)bisphenol, 4,4'-(p-phenylenediisopropylidene)bisphenol and 4,4'-(m-phenylenediisopropylidene)bisphenol, and wherein to the recording layer is added at least one heat-fusible substance represented by the formula (I)

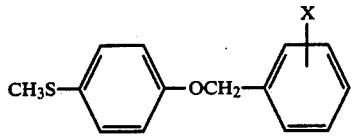

(I)

wherein X is hydrogen atom, halogen atom, $C_{1-4}$ alkyl or $C_{1-4}$ alkoxyl.

2. A heat sensitive recording material as defined in claim 1 wherein the heat-fusible substance of the formula [I] is at least one compound selected from the group consisting of benzyl 4-methylthiophenyl ether, 4-chlorobenzyl 4'-methylthiophenyl ether, 3-chlorobenzyl 4'-methylthiophenyl ether, 4-bromobenzyl 4'-methylthiophenyl ether, 4-methylbenzyl 4'-methylthiophenyl ether, 2-methylbenzyl 4'-methylthiophenyl ether, 4-n-butylbenzyl 4'-methylthiophenyl ether and 4-methoxybenzyl 4'-methylthiophenyl ether.

3. A heat sensitive recording material as defined in claim 1 wherein the color acceptor is used in an amount of 100 to 700 parts by weight per 100 parts by weight of the basic dye.

4. A heat sensitive recording material as defined in claim 1 wherein the heat-fusible substance is used in an amount of 1 to 1000 parts by weight per 100 parts by weight of the color acceptor.

5. A heat sensitive recording material as defined in claim 1 wherein said basic dye comprises 3-di(n-butyl-)amino-6-methyl-7-phenylaminofluoran and/or 3-di(n-pentyl)amino-6-methyl-7-phenylaminofluoran.

6. A heat sensitive recording material as defined in claim 1 including additionally adding to said recording layer at least one compound selected from the gropu consisting of tetrakis[3-(3,5-di-tert-butyl-4-hydroxyphenyl)propionyloxymethyl]methane, 1,3,5-tris(3,5-di-tert-butyl-4-hydroxybenzyl)-2,4,6-trimethylbenzene and compounds of the formula (II)

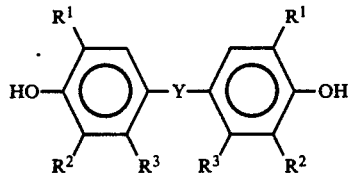

[II]

wherein $R^1$ is a branched-chain $C_{3-8}$ alkyl, cycloalkyl, phenyl or halogen atom, $R_2$ is hydrogen atom, straight-chain $C_{3-8}$ alkyl, branched-chain $C_{3-8}$ alkyl or halogen atom, $R^3$ is hydrogen atom or straight-chain $C_{1-4}$ aklyl, Y is —O—, —S—, —S—S—, —$SO_2$— or —$C(R^4)R^5$)—, $R^4$ and $R^5$ are each hydrogen atom or straight-chain $C_{1-8}$ alkyl, and may, taken together, for a ring.

7. A heat sensitive recording material as defined in claim 6 wherein the compound of the formula (II) is 4,4'-butylidenebis(2-tert-butyl-5-methylphenol).

* * * * *